US005667219A

United States Patent [19]

Ishibashi

[11] Patent Number: 5,667,219

[45] Date of Patent: Sep. 16, 1997

[54] VARIABLE DISPLAY GAMING MACHINE

[75] Inventor: Kazuyoshi Ishibashi, Tokyo, Japan

[73] Assignee: Universal Sales Co., Inc. Ltd., Japan

[21] Appl. No.: 362,149

[22] Filed: Dec. 22, 1994

[30] Foreign Application Priority Data

Dec. 24, 1993 [JP] Japan ..... 5-328843

[51] Int. Cl.[6] ..... A63F 7/00; G07F 17/34

[52] U.S. Cl. ..... 273/143 R

[58] Field of Search ..... 273/143 R

[56] References Cited

U.S. PATENT DOCUMENTS

| | | | |
|---|---|---|---|
| 5,004,238 | 4/1991 | Okada | 273/121 B |
| 5,031,911 | 7/1991 | Okada | 273/121 B |
| 5,154,421 | 10/1992 | Hamano | 273/143 R |
| 5,219,167 | 6/1993 | Hamano | 273/143 R |
| 5,251,898 | 10/1993 | Dickenson | 273/143 R |

FOREIGN PATENT DOCUMENTS

| | | | |
|---|---|---|---|
| 0414428 A3 | 2/1991 | European Pat. Off. | G07F 17/34 |

*Primary Examiner*—William H. Grieb
*Attorney, Agent, or Firm*—Rohm & Monsanto

[57] ABSTRACT

A gaming machine has a variable display device for variably displaying symbols for each of a plurality of symbol columns by moving each of the plurality of symbol columns separately in a predetermined direction. The plurality of symbol columns are each formed by a plurality of symbols arranged in the predetermined direction. A drive signal for operating the variable display device is generated when predetermined gaming conditions are satisfied. In response to the drive signal, there is determined a combination of stop symbols to be displayed when the symbol columns are stopped. Positions of the stop symbols are detected separately for the symbol columns, respectively, and position signals indicative of the positions of the stop symbols are generated, respectively. Correction amounts for correcting the positions of the stop symbols are determined based on the position signals. In response to the drive signal, control of the movement and stop of the symbol columns displayed by the display means is carried out, such that the movement of the symbol columns is controlled at the start of movement thereof by the use of the correction amounts until the speed of movement of each of the symbols columns reaches a predetermined uniform speed.

11 Claims, 14 Drawing Sheets

VARIABLE DISPLAY GAMING MACHINE

BACKGROUND OF THE INVENTION

1. Field of the Invention

This invention relates to a gaming machine, such as a slot machine, and a pachinko game machine, as well as a ball-shooting game machine, which is provided with a variable display block for variably displaying a plurality of symbols thereon.

2. Prior Art

In a slot machine, for example, there is employed as the variable display block, a display mechanism of a rotation reel type, in which reels each having a plurality of symbols arranged on its peripheral surface are driven for rotation by drive means, such as a stepping motor. During the game, a win or a lose is determined depending on combinations of symbols positioned along predetermined win lines when the reels are stopped, and if a play of the game results in a win, a number of coins or medals corresponding to a kind of the win is paid out.

In gaming machines adapted to vary a display of symbols in a plurality of columns as described above, the variable display of symbols is controlled by a control system comprised of a microcomputer so as to prevent a probability of winning plays from being dependent on player's skill.

More particularly, in the case of a slot machine, when the player operates a lever or a start button, the control system drives the reels of the variable display block for rotation, and at the same time samples a random number. Then, the control system determines whether or not the sampled random number corresponds to a win with reference to a predetermined winning condition table, and based on results of the determination, symbols (stop symbols) are determined which should be displayed within a viewing window through which the symbols are visible when the reels are stopped, followed by stopping the rotation of the reels after a predetermined time period.

In a ball-shooting game machine, such as a pachinko game machine, neither the lever nor the start button is operated, but upon entry of a shot game ball into a win area called a "start hole", a control system starts to operate a variable display block and at the same time samples a random number. The control system makes a determination based on the random number with reference to a winning condition table whether or not the present play is a win or a lose, whereby the stop symbols are determined, followed by stopping the variable display after a predetermined time period.

Further, in the case of a gaming machine provided with a variable display block of a video type, e.g. formed by a CRT (Cathode Ray Tube), graphics data corresponding to symbol patterns is stored in a memory device (symbol ROM) in a predetermined order, and a control system reads data of symbols patterns to be displayed on the variable display block from the symbol ROM.

In any case, in gaming machines provided with a variable display block, movement of a plurality of symbol columns is controlled by a microcomputer or the like, for stop thereof at a predetermined position.

As described above, in conventional slot machines, the control system causes all the reels to start rotation and enter the state of uniform rotation, and then after a predetermined time period, controls the stop of the rotation of the reels such that stop symbols are displayed, which are determined based on a prior win determination. During this stop control, however, the reels are not stopped at equal time intervals. This is because the stop symbols to be lined up along a win line are positioned on different locations or levels on respective reels, and hence it is required to correct the timing of the deceleration and stopping process in order to line up the stop symbols on the win line. That is, the time intervals of the process of stopping the respective reels requires different time durations for each such reel. For example, assuming that three reels start to be rotated simultaneously, and then a first reel, a second reel, and a third reel are automatically and sequentially stopped in the right-to-left order as mentioned, a time interval from the stopping of the first reel to the stopping of the second reel can be significantly different from a time interval from the stop of the second reel to the stop of the third reel.

In this way, since the timing of stop the stopping of each reel bearing an endless symbol column is irregular, a player can feel that the stop symbols are lined up along the win line not by chance depending on timing of a pull of the lever, but by intentional control by the slot machine, which can make him uninterested in the game. This disadvantageous characteristic inconvenience can become with a type of the slot machine which is not provided with reel stop buttons, but adapted to stop the reels after a predetermined time period. Further, in the case of a ball-shooting game machine as well, irregularity of time intervals of stop of symbol columns of the variable display block can cause the same loss of interest in the game.

In particular, in these gaming machines, whether a play is a win or a lose is known only when all the symbol columns are stopped, and hence the player watch for stopping of the symbol columns with much interest. If, in spite of such keen interest of players in this moment, timing of stop of the symbol columns is irregular, the players can lose interest in the game.

SUMMARY OF THE INVENTION

It is an object of the invention to provide a gaming machine having a variable display block for variably displaying a plurality of symbols, which is capable of displaying predetermined stop symbols while eliminating irregularities of time intervals of the stopping of symbol columns.

It is another object of the invention to provide a gaming machine which eliminates irregular operations of symbol columns when they are stopped, thereby preventing a player from losing interest in the game.

To achieve the above objects, the present invention provides a gaming machine comprising:

- a variable display device for variably displaying symbols for each of a plurality of symbol columns by moving the each of the plurality of symbol columns in a predetermined direction, the each of the plurality of symbol columns being formed by a plurality of symbols arranged in the predetermined direction;
- drive signal-generating means for generating a drive signal for operating the variable display device, when predetermined gaming conditions are satisfied;
- stop symbol-determining means responsive to the drive signal for determining a combination of stop symbols to be displayed when the symbol columns are stopped;
- position-detecting means for detecting positions of the stop symbols separately for the symbol columns, respectively, and for generating position signals indicative of the positions of the stop symbols, respectively;
- correction amount-determining means for determining correction amounts for correcting the positions of the stop symbols based on the position signals generated by the position-detecting means; and control means responsive to the drive signal for controlling the movement and stopping of the symbol columns displayed by the display means, such that the movement of the symbol columns is controlled at the start of movement thereof by the use of the correction amounts determined by the correction amount-determining means until the speed of movement of each of the symbols columns reaches a predetermined uniform speed.

Preferably, the control means controls the movement and stopping of the symbol columns, such that the stop symbols are lined up when the symbols columns are stopped, by using the correction amounts determined by the correction amount-determining means for correcting the positions of the stop symbols detected by the position-detecting means to thereby cause the symbols to be lined up when the symbols columns are stopped.

In a preferred embodiment, the correction amounts are defined as differences in the time the movement of the respective symbol columns is started.

Preferably, the control means starts the movement of the plurality of symbol columns in such an order that the differences in time points for starting the movement of the symbol columns is minimized.

In another preferred embodiment, the correction amounts are defined as differences in accelerating time periods over which the symbol columns are accelerated until the speed of movement of each of the symbol columns reaches the predetermined uniform speed.

Preferably, the control means starts the movement of the plurality of symbol columns with reference to an accelerating time period of a first one of the plurality of symbols columns to be started for movement, in such an order that the differences in the accelerating time periods is minimized.

For example, the gaming machine may be a slot machine, or a ball-shooting game machine.

The above and other objects, features and advantages of the present invention will become more apparent from the following description when taken in conjunction with the accompanying drawings which illustrate preferred embodiments of the present invention.

DETAILED DESCRIPTION OF THE PREFERRED EMBODIMENTS

The invention will now be described in detail with reference to drawings showing embodiments of the invention.

Figure 1:
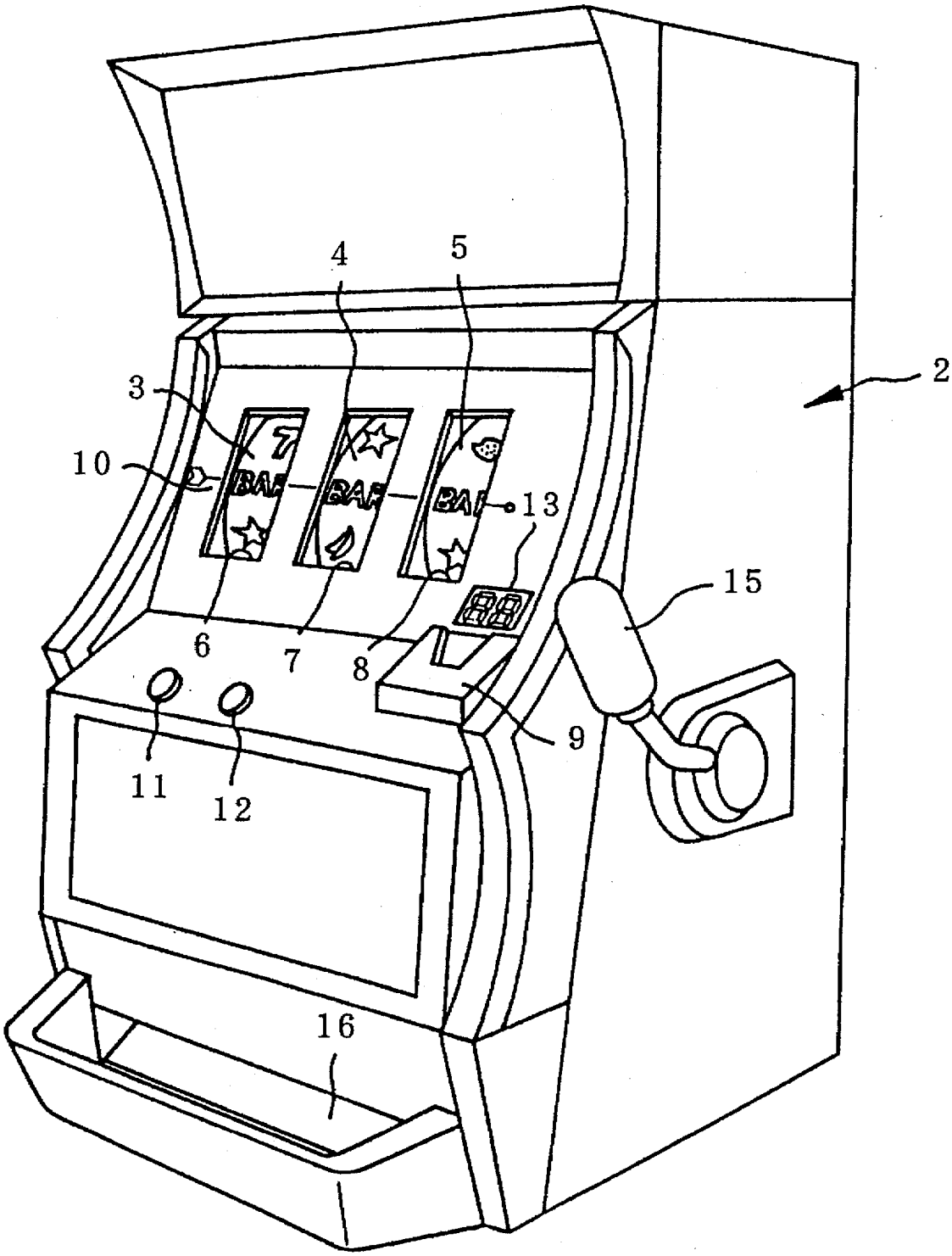
FIG. 1 is a perspective view showing an appearance of a slot machine according to an embodiment of the invention.
Figure 6:
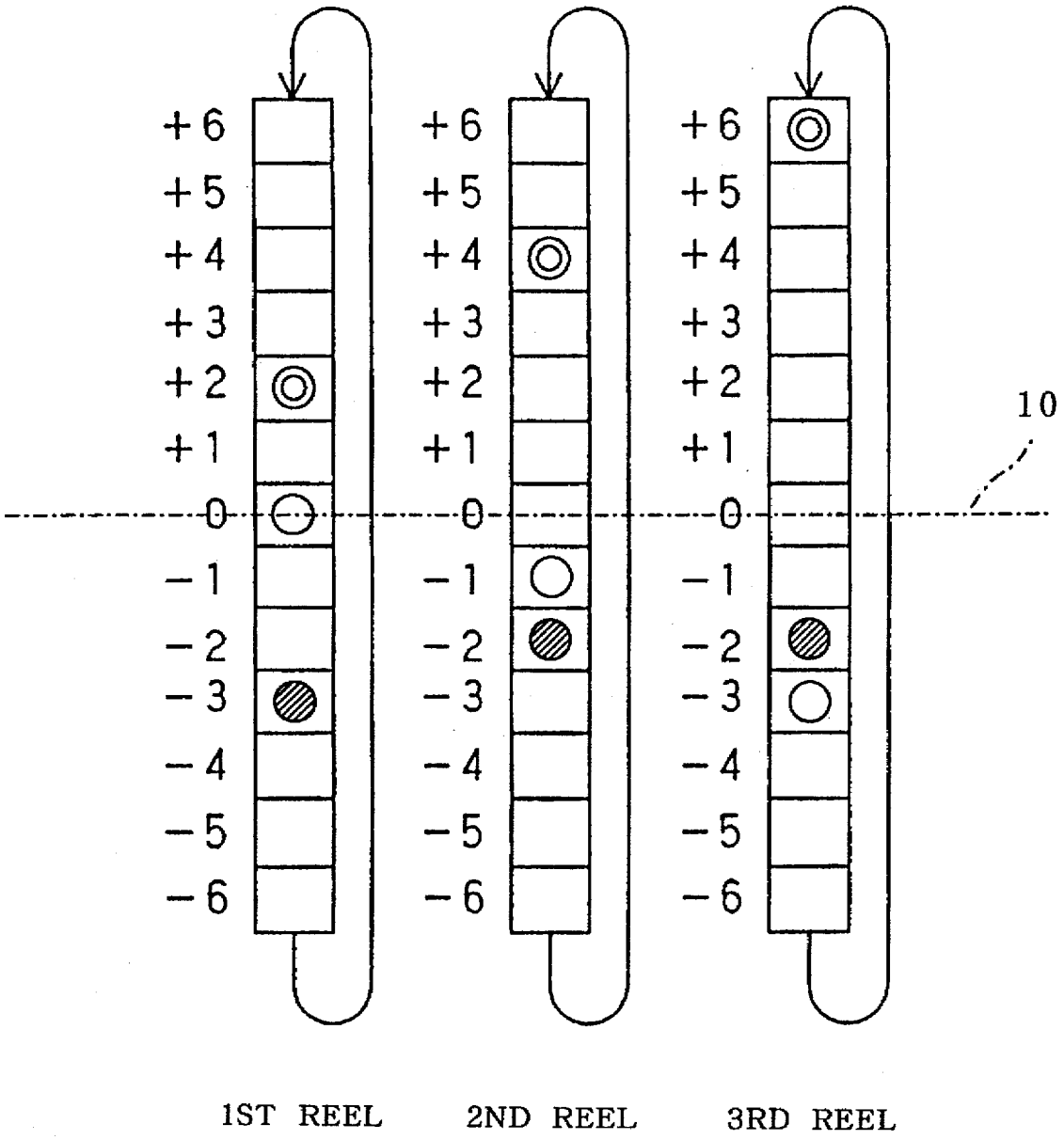
FIG. 6 is an explanatory diagram showing positions of symbols on reels and position codes indicative thereof.

Referring first to FIG. 1, there is shown an appearance of a slot machine according to a first embodiment of the invention. In a body 2 of the slot machine, there are rotatably accommodated three reels constituting a variable display block: a first reel 3, a second reel 4, and a third reel 5. The reels 3, 4, and 5 each has an outer peripheral surface which is divided into thirteen sections as shown in FIG. 6, referred to hereinafter. The reel 3 to 5 each bear symbols of"star", "bar", "lemon", etc. painted in the thirteen sections, respectively. Three symbols per reel can be viewed through windows 6, 7, and 8 formed in a front face of the body 2.

One to three coins can be deposited for a play with this slot machine, and upon entry of one coin into a coin entry slot 9, a single win line 10 is made active. The active state of the win line 10 is notified to a player by lighting of a lamp, not shown, provided corresponding to the win line 10 in the front face-of the body 2. In the front face of the body 2, there are also provided a credit button 11 and a coin entry button 12. If the player depresses the credit button 11, he can credit e.g. 1 to 50 coins. The number of coins to the player's credit is displayed on a credit number display 18.

When the player operates a start lever 15 after inserting coins, the first reel 8, the second reel 4, and the third reel 5 start rotation such that display symbols on the reels move downward. When a predetermined time period has elapsed after the reels 3, 4, and 5 have entered a state of uniform rotation, the reels are stopped in the order of the first reel 3, the second reel 4, and the third reel 5, at intervals of a predetermined time period, such that the next reel to stop further moves an additional amount corresponding to two symbols. Then, if a combination of symbols stopped in the win line 10 corresponds to a win, a number of coins corresponding to a kind of the win and the number of coins deposited are paid back on a payout tray 16. In this connection, even if the credit button has been depressed, a number of coins to the player's credit in excess of an upper limit of creditable coins are also paid back to the payout tray 16.

Figure 2:
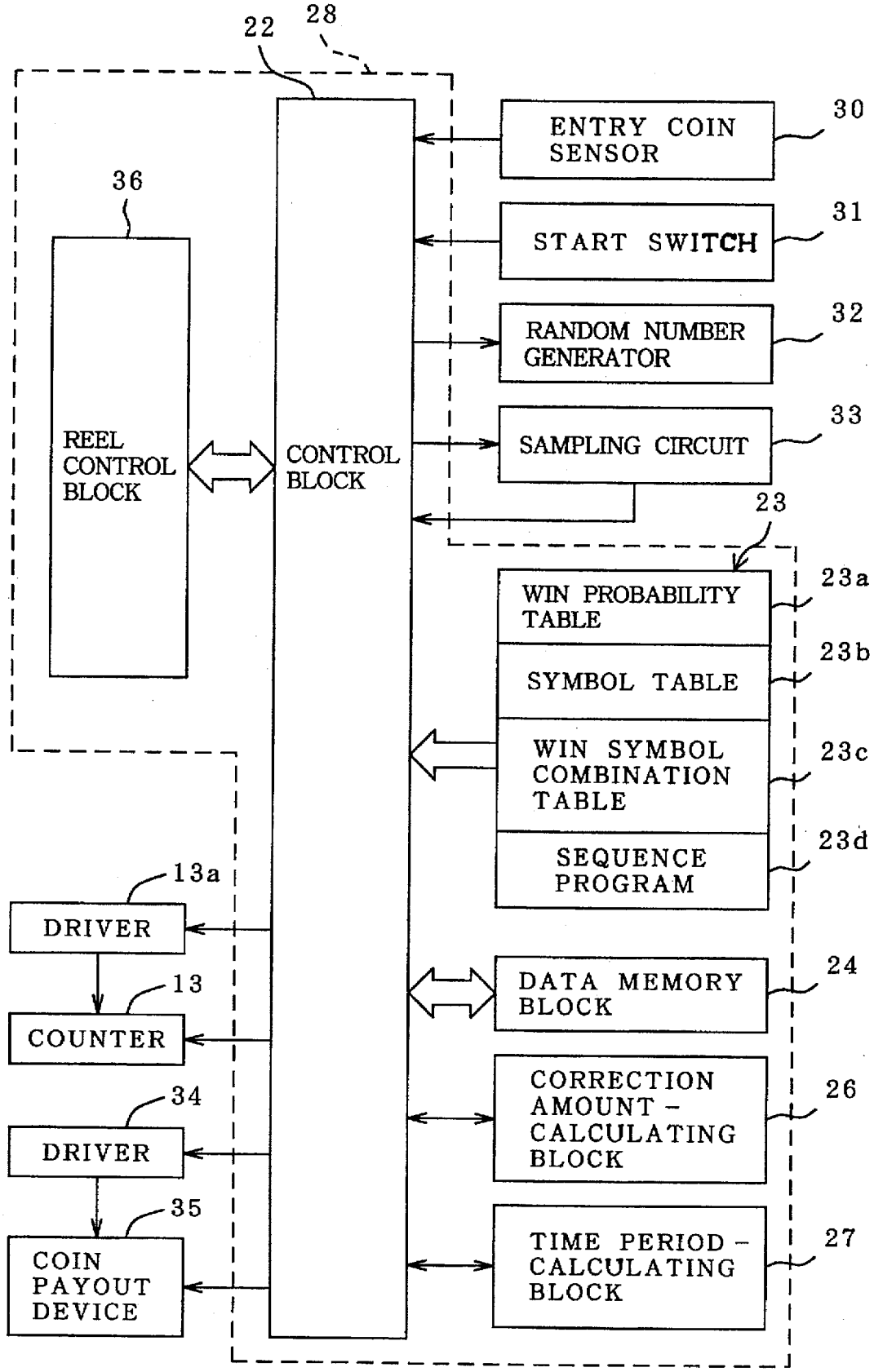
FIG. 2 is a block diagram showing a circuit configuration of control means of the slot machine.

In the present embodiment, as will be described in detail hereinafter, the rotation of the reels is controlled such that the reels start to be rotated by timing to respective different time points of start, so as to stop the reels at equal time intervals, FIG. 2 shows an outline of a circuitry configuration of the slot machine. The overall gaming procedure is controlled by a control block 22. The control block 22 constitutes a system controller 28, together with a memory block 23, a data memory block 24, a correction amount-calculating block 26, a time period-calculating block 27, and a reel control block 36, all of which will be described in detail below. The system controller 28 is implemented by a microcomputer, and a CPU thereof forms the control block 22.

Connected to the control block 22 are an entry coin sensor 30 for generating a game start signal when entry of a coin via the coin entry slot 9 into the slot machine is detected or when the coin entry button 12 is operated, a start switch 31 for generating a start signal when the start lever 15 is operated or pulled, a random number generator 32 operated when the start signal is generated for generating random numbers within a predetermined value range, and a sampling circuit 33 for sampling one of the random numbers by timing to a predetermined time point after generation of the random numbers, as well as a counter 13 via a driver 13*a* and a coin payout device 35 via a driver 34.

Figure 3:
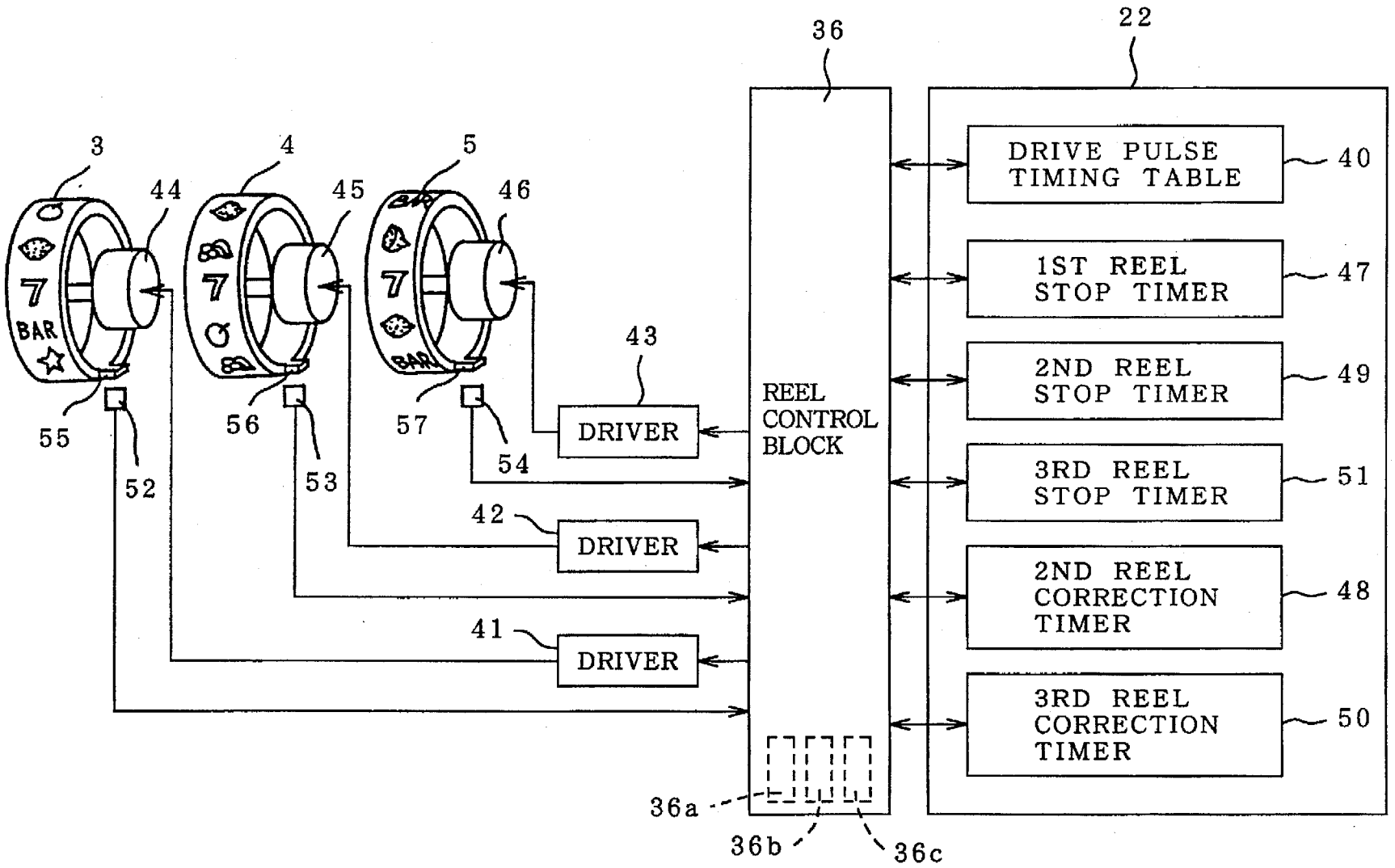
FIG. 3 is a diagram showing the arrangement of a reel drive mechanism and a control circuitry associated therewith.

The system controller 28 also includes a reel control block 36, the function thereof being attained by a program executed by the microcomputer. FIG. 3 shows a reel control mechanism, i.e. a reel drive mechanism for driving the reels 3, 4, and 5 and a control circuitry associated therewith for control of drive and stop of the reels. As shown therein, the reel control block 36 as part of the control circuitry sends signals for control of drive of the reels to drivers 41, 42, and 43 connected to stepping motors 44, 45, and 46 for driving the reels 3, 4, and 5 for rotation. The stepping motors 44, 45, and 46 are controlled for respective rotational amounts by the number of drive pulses supplied thereto from the reel control block 36, and for respective rotational speeds by intervals of drive pulses supplied thereto from same. There are provided three types of intervals of drive pulses, i.e. one for acceleration control, one for uniform rotation, and one for stop control, data of which is entered in a drive pulse timing table 40. Therefore, accelerating time periods over which the stepping motors 44, 45, and 46 are accelerated to a predetermined rotational speed of uniform rotation of the reels are identical to each other, and stop time periods over which the stepping motors 44, 45, and 46 rotating at the predetermined rotational speed are decelerated to stoppage are also identical to each other. In this connection, numbers of drive pulses supplied from the reel control block 36 to the stepping motors 44, 45, and 46 are counted by three counters 36*a*, 36*b*, and 36*c*, respectively.

The control block 22 as part of the aforementioned control circuitry, which operates to control the drive and halt of the stepping motors 44, 45, and 46, includes a first reel stop timer 47 for setting a predetermined time period as desired, over which drive pulses should be supplied to the stepping motor 44, a second reel correction timer 48 for setting timing of start of the supply of drive pulses to the stepping motor 45, a second reel stop timer 49 for setting timing of start of stop control of the stepping motor 45, a third reel correction timer 50 for setting timing of start of the supply of drive pulses to the stepping motor 46, a third reel stop timer 51 for setting timing of start of stop control of the stepping motor 46, beside the aforementioned drive pulse timing table 40. These component parts send and receive signals to and from the reel control block 36.

The first reel stop timer 47 is set to the aforementioned predetermined time period. Further, the second reel correction timer 48 and the third reel correction timer 50 are set to respective set time periods based on delay time periods determined as will be described hereinafter. The first reel stop timer 47 and the second reel correction timer 48 are started upon setting of the respective set time periods, and the third reel correction timer 50 is started when the second reel correction timer 48 runs out.

The second reel stop timer 49 and the third reel stop timer 51 are set to respective fixed time periods such that the time intervals of the stopping of the reels are identical to each other. The setting of the time intervals of the stopping of the reels causes one reel to move further in an additional amount corresponding to two symbols by way of example in the present embodiment over a time period from a stop of a preceding reel to a stop of the one reel, as can be calculated from the relationship between the rotational speed $N_1$ set to the uniform rotation of the reels, the number A of all the symbols on each reel, and each time interval of stop of the reels. That is, a position of stop of one reel is shifted in a direction of rotation by an amount corresponding to two symbols relative to a position of stop of the preceding reel. The second reel stop timer 49 starts when stop control of the first reel is started after the first reel stop timer 47 runs out, and the third reel stop timer 51 starts when the second reel stop timer 49 runs out.

The reel control block 36 is connected to photosensors 52, 53, and 54 for detecting optical block pieces 55, 56, and 57 which intercept light transmitted to the photosensors 52, 53, and 54, respectively. These photosensors each generate a reset pulse for resetting the counters 36*a*, 36*b* and 36*c*, when they detect the optical block pieces 55, 56, and 57, respectively. More specifically, when the reset pulse is generated from one of the photosensors 52, 53, and 54, the count of a corresponding one of the counters 36*a*, 36*b* and 36*c* is reset to "0". Therefore, the count of each counter corresponds a rotational angle of the reel associated therewith within one rotation thereof. Since an order of symbols arranged on the reels at a fixed pitch is known in advance, it is possible to determine what kinds of symbols are positioned along the win line 10 at a specific time point, only if the rotational angles of the reels 3, 4, and 5 with reference to respective predetermined positions thereof are known at the specific time point from the counts of the counters 36*a*, 36*b*, and 36*c*.

The count of each of the counters 36*a*, 36*b*, and 36*c* corresponds to one of thirteen position codes "0 to 12" of each of the reels 3, 4, and 5, and is stored via the control block 22 for each counter into the data memory block 24 to update old data therein. Thus, the reel control block 36 can be aware of the rotational position of each symbol on the reels 3, 4, and 5 within a range of one rotation.

According to the circuitry configuration of the slot machine described above, when the player operates the start lever 15 as described above, the start switch 31 sends a start signal to the control block 22. In response to the start signal, the control block 22 places the random number generator 32 and the sampling circuit 33 into operation to carry out sampling of a random number. A sampled random number is delivered from the sampling circuit 33 to the control block 22.

The memory block 23 appearing in FIG. 2 stores therein a win probability table 23*a*, a symbol table 23*b*, a win symbol combination table 23*c*, and a sequence program 23*d*. The win probability table 23*a* contains data for classifying random numbers generated from the random number generator into groups of a "big hit", a "medium hit", and a "small hit" depending on the magnitude of each random number. The symbol table 23*b* contains data of correspondence between the position codes "0 to 12" representative of the rotational positions with respect to the reference position of each reel and symbol codes representative of kinds of symbols arranged around each reel. The win symbol combination table 23*c* contains data of combinations of symbols corresponding to the big hit, the medium hit, or the small hit, and the sequence program 23*d* contains data of processing procedures of a gaming program.

The control block 22 determines with reference to the win probability table 23*a*to which win group the sampled random number belongs. If it does belong to any of the groups, the control block 22 writes one of a "big hit flag", a "medium hit flag", and a "small hit flag" depending on the kind of the win into the data memory block 24. If the sampled random number does not assume any of the values stored in the win probability table 23*a*, a "lose flag" is written into the data memory block 24. Then, the control block 22 determines a combination of stop symbols which satisfy the flag written into the data memory block 24.

The determination of stop symbols is carried out before the reels start to rotate. To determine the stop symbols, reference is made to the present stop positions of the reels 3, 4, and 5, the symbol table 23*b* and the win symbol combination table 23*c*. The present stop positions of the reels can be determined from the counts of the counters 36*a* to 36*c*. Then, symbols in the above combination are selected from the reels at the present stop positions, respectively, which satisfy conditions of being lined up in a row (a horizontal line, in the present embodiment) or least deviated from a possible row when the second reel 4 is rotated further relative to the first reel 3 by an amount corresponding to two sections of symbols, and the third reel 5 relative to the second reel 4 by the same amount. This is intended to minimize correction amounts, referred to hereinafter, which are used in correcting discrepancy amounts of stop positions of stop symbols on the reels, which should stop at equal time intervals, to thereby effect the most efficient corrections, since one reel can bear a plurality of symbols of the same kind. Thus, the stop symbols at respective particular positions on the reels are determined, and at the same time, position codes representative of the rotational positions of the stop symbols are determined from the positions of the symbols on the reels, whereby the positions of the stop symbols to be displayed along the win line 10 on the following occasion are determined unconditionally.

As described above, when the positions of the stop symbols on respective reels to be stopped next time along the win line 10 at the end of the present play are determined, "reel-to-reel discrepancy amounts" concerning positions of the stop symbols taken when the reels are merely caused to stop at equal time intervals without any correction are calculated with reference to the position codes of the symbols currently lined up along the win line, by the correction amount-calculating block 26. That is, a reel-to-reel discrepancy amount between the first reel 3 and the second reel 4, and one between the second reel 4 and the third reel 5 are calculated by the correction amount-calculating block 26. The reel-to-reel discrepancy amounts will be also referred to hereinafter as "correction amounts" for correcting timing of the start of rotation of the second reel 4 and the third reel 5, so as to cause the stop symbols to be lined up in a row along the win line 10 when the reels are stopped at equal time intervals after the reels reached the state of uniform rotation. Data of the reel-to-reel discrepancy amount between the first reel 3 and the second reel 4 and that between the second reel 4 and the third reel 5 is sent to the time period-calculating block 27.

The time period-calculating block 27 calculates from the two correction amounts a delay time period $T_3$ corresponding to a difference between a time point of start of drive of the first reel 3 and a time point of start of drive of the second reel 4, and a delay time period $T_4$ corresponding to a difference a time point of start of drive of the second reel 4 and a time point of start of drive of the third reel 5, and sends data of these delay time periods $T_3$ and $T_4$ via the control block 22 to the reel control block 36. The delay time periods $T_3$ and $T_4$ can be determined from the following equations (1) and (2), details of which will be described later:

$$T_3=\{(R_{12}+N_1\times A\times T_2)-K_1\}/(N_1\times A) \quad (1)$$

provided that if $(R_{12}+N_1\times A\times T_2)<A$, $K_1=0$, and if $(R_{12}+N_1\times A\times T_2)\geqq A$, $K_1=A$.

$$T_4=\{(R_{23}+N_1\times A\times T_2)-K_2\}/(N_1\times A \quad (2)$$

provided that if $(R_{23}+N_1\times A\times T_2)<A$, $K_2=0$, and if $(R_{23}+N_1\times A\times T_2)\geqq A$, $K_2=A$ In the above equations (1) and (2), $T_2$, $T_3$ $T_4$, $R_{12}$, $R_{23}$, $N_1$, and A are defined as follows:

$T_2$: time intervals of stop of each reel $T_3$: delay time period for second reel to wait before start rotation $T_4$: delay time period for third reel to wait before rotation after the second reel has started $R_{12}$: number of sections of symbols required for stop symbol on first reel to pass through before it is in a row with stop symbol on second reel $R_{23}$: number of sections of symbols required for stop symbol on second reel to pass through before it is in a row with stop symbol on third reel $N_1$: rotational speed of reels set for uniform rotation thereof A: number of all the symbols on a reel The reel control block 26 sets the delay time period $T_3$ to the second reel correction timer 48, and the delay time period $T_4$ to the third reel correction timer 50. In this connection, the second reel stop timer 49 and the third reel stop timer 51 are automatically reset to the time period $T_2$ when the second reel stop timer 49 and the third reel stop timer 51 themselves run out, and the first reel stop timer 47 is also automatically reset to the time period $T_5$ when the first reel stop timer 47 runs out, for use in a subsequent play of the game.

Next, the operation of the slot machine constructed as above will be described with reference to FIG. 4 to FIG. 6.

Figure 4:
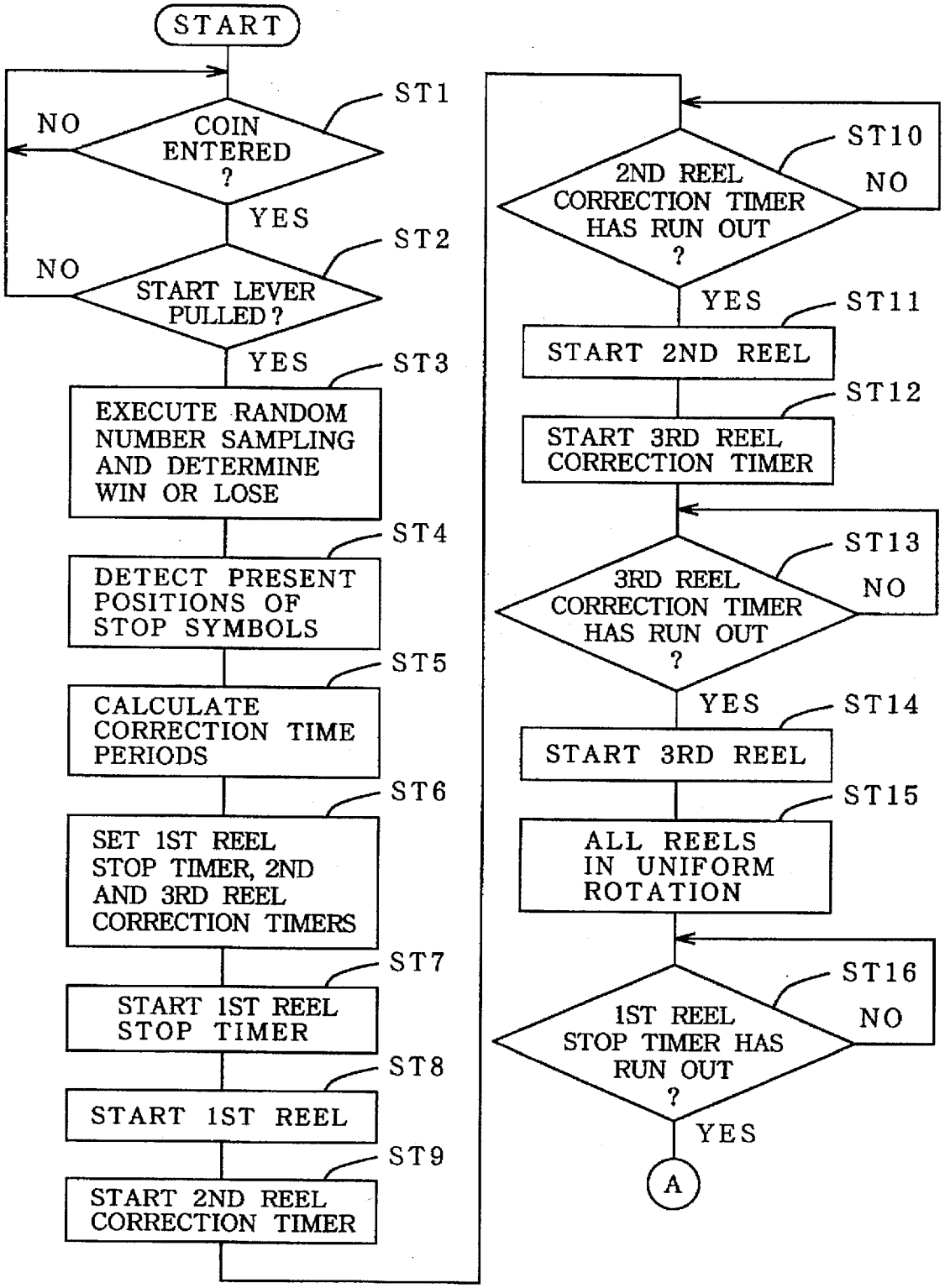
FIG. 4 is a flowchart showing reel control processing executed by the slot machine.
Figure 5:
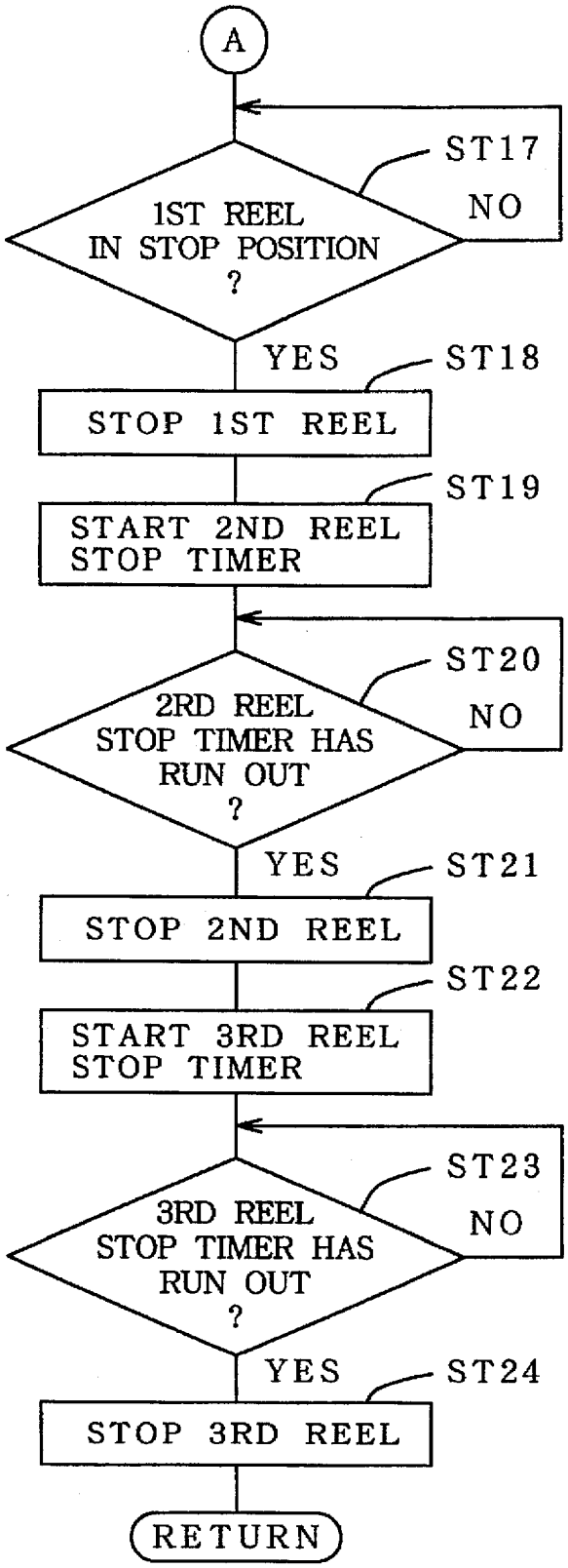
FIG. 5 is a flowchart showing a continuation of the FIG. 4 flowchart.

In FIG. 4, when a coin is entered at a step ST1, the start lever 15 is made operative. If the start lever 15 is operated or pulled at a step ST2, the aforementioned start signal is delivered to the control block 22. In response to the start signal, the control block 22 causes the random number generator 32 and the sampling circuit 33 to operate at a step ST3, whereby a random number is sampled, and then a win determination of the sampled random number as to whether the sampled number corresponds to any of the big hit, the medium hit, and the small hit is carried out with reference to the win probability table 23*a*.

If the win determination results in the "big hit", the control block 22 determines a combination of symbols constituting the big hit (e.g. "BAR, BAR, BAR") is determined such that the reel-to-reel discrepancy amount is the minimum, with reference to the present stop positions of the reels 3, 4, and 5, the symbol table 23*b*, and the win symbol combination table 23*c*.

Then, at a step ST4, the control block 22 detects the present positions of the symbols (stop symbols) "BAR" on the reels 3, 4, and 5, which are to be displayed along the win line 10 when the reels are stopped, with reference to the symbol table 23*b*.

FIG. 6 schematically shows the positions of all the symbols on the first to third reels in which one cycle of symbols on each reel is shown with the win line 10 as the origin "0" and a positional scale graduated in pitches of positions of symbols is provided for each reel. In reality, however, as described hereinabove, the position codes of "0 to 12" are allotted to the positions of symbols, and based on the position codes, the positions of the symbols on the reels during rotation or in stop are determined, whereby the reel-to-reel discrepancy amounts and so forth are calculated. In FIG. 6, it is assumed that the reels are rotated in directions of arrows. Further, if the stop symbols of "BAR" are positioned at sections indicated by ● on the reels, respectively, when the reels are in stop, data of the position codes of these symbols of "BAR" on the reels is sent to the correction amount-calculating block 26.

A section on each reel indicated by ○ designates a position where a symbol of "BAR" is stopped, assuming that the reels are started simultaneously without being corrected for time periods during which the reels rotate, and the symbol "BAR" on the first reel 3 is first stopped on the win line 10, followed by the second reel 4 and the third reel 5 at the aforementioned time intervals of $T_2$. Further, as described hereinafter, when the reels are rotating at uniform speed, each symbol is moved in an amount corresponding to two sections of symbols as the time period $T_2$ elapses, and hence to halt the stop symbols of "BAR" in a row along the win line 10, it is only required to delay the timing of start of rotation of the second reel 4 and the third reel 5 such that the stop symbols of "BAR" assume respective positions indicated by ⊙ when the deceleration control of the first reel 3 starts, and hence when the reels are in uniform rotation. The correction amount-calculating block 26 calculates the correction amounts based on the data of the position codes as the aforesaid "reel-to-reel discrepancy amounts".

That is, in FIG. 4, time periods for delaying the timing of start of rotation of the second reel and the third reel are calculated at a step ST5. More specifically, from data of position codes of the stop symbols "BAR" on the reels 3, 4, and 5 in stop, the reel-to-reel discrepancy amounts are calculated. The reel-to-reel discrepancy amounts are represented by $\{(R_{12}+N_1\times A\times T_2)-K_1\}$ and $\{(R_{23}+N_1\times A\times T_2)-K_2\}$ in the above equations (1) and (2).

Referring again to FIG. 6, when the first and the second reels are in stop, the stop symbols of "BAR" thereon assume positions of "–3" and "–2", respectively. To move the stop symbol of "BAR" on the first reel 3 to a position in a row with the stop symbol of "BAR" on the second reel 4, the first reel 3 is required to rotate in an amount corresponding to 12 sections of symbols, and hence $R_{12}$ in the above equation (1) is equal to 12. This represents the number of sections of symbols on the first reel 3 for which the second reel 5 should wait to pass before the stop symbol of "BAR" on the first reel is brought to the position corresponding to the stop symbol of "BAR" on the second reel 5. In this connection, in the present embodiment, it is assumed that the time interval $T_2$ of stop of reels is equal to 200 msec, and the rotational speed $N_1$ of the reels at uniform rotation is equal to 46.15 rpm, and therefore, since the number A of all the symbols on each reel is equal to 13, the number of sections of symbols which the second reel 4 should pass after the first reel has stopped is, as already stated hereinabove, equal to: $N_1\times A\times T_2=(46.15/60)\times 13\times(200\times 10^{-3})\approx 2$.

Therefore, the reel-to-reel discrepancy amount between the first reel 3 and the second reel 4 which should be corrected so as to put the stop symbols of "BAR" on the first reel and the second reel in a positional relationship as indicated by symbols ⊙ in FIG. 6, is equal to an amount of 12+2=14(in terms of the number of sections for symbols). That is, in starting rotation of the reels, the second reel should start to be rotated later than the first reel 3 by a time period corresponding to 14 sections of symbols. However, since the number of symbols on the reel is 13 in total, if correction is made in the amount corresponding to 14 sections of symbols, an amount of one rotation of the second reel is excessively corrected. Therefore, a sufficient amount of correction is equal to an amount corresponding to (14–13=) 1 section of a symbol. The subtraction of $K_1$ in the above equation (1) is intended for this correction.

Similarly, since $R_{23}=0$, the reel-to-reel discrepancy amount between the second reel 4 and the third reel 5 calculated is equal to an amount of $[(R_{23}+N_1\times A\times T_2)=0+2]=2$ in terms of the number of sections of symbols. This value of 2 is smaller than 13, and therefore, $K_2=0$ and the reel-to-reel discrepancy amount between the second reel 3 and the third reel 4 which should be corrected is equal to 2 in terms of sections of symbols.

The time period-calculating block 27 calculates delay time periods for delaying the start of rotation of the second reel 4 and the third reel 5 from the correction amounts, i.e. the reel-to-reel discrepancy amounts. That is, since a time period which takes a particular symbol on a reel to move in an amount of one section of a symbol is equal to $1/N_1\times A=100$ (msec) at the uniform rotation, the delay time period $T_3$ equivalent to the reel-to-reel discrepancy amount between the first reel 3 and the second reel 4 is equal to $T_3=100$ (msec), and similarly, the delay time period $T_4$ equivalent to the reel-to-reel discrepancy amount between the second reel 4 and the third reel 5 is equal to $T_4=200$ (msec).

When the data of the above delay time periods $T_3$ and $T_4$ is sent to the reel control block 36, a step ST6 in FIG. 4 is carried out. That is, the second reel correction timer 48 is set to the time period $T_3$ and the third reel correction timer 50 is set to the time period $T_4$. At this time, the first reel stop timer 47 is already set to the predetermined time period $T_5$, and the second reel stop timer 49 and the third reel stop timer 51 to the predetermined time period $T_2$, as stated above. In this connection, the set time period $T_5$ for the first reel stop timer 47 is set to a desired time period long enough for all the reels to enter the state of uniform rotation at a fixed rotational speed, as will be described hereinafter with reference to a step ST15.

Figure 7:
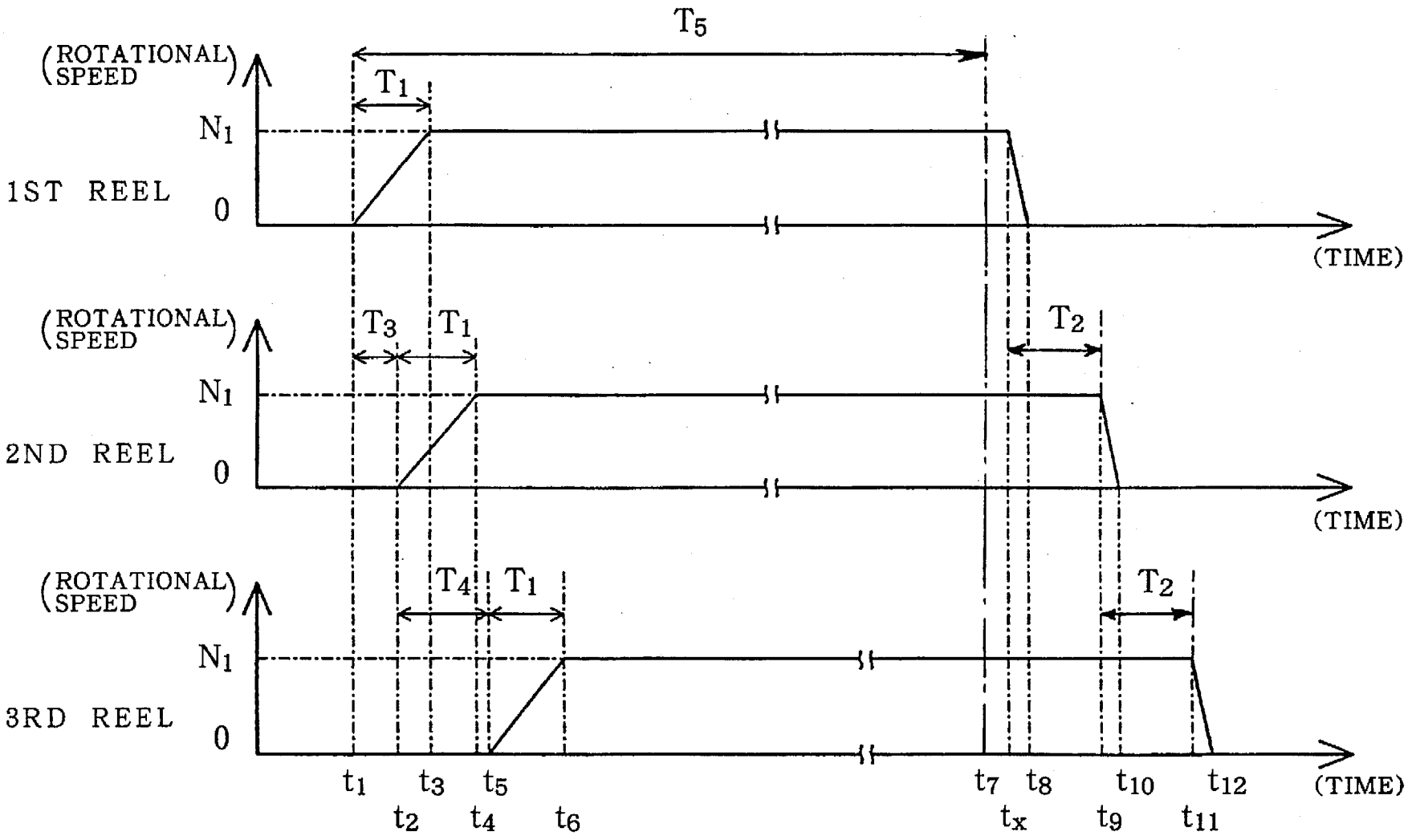
FIG. 7 is a timing chart showing the operations of three reels under drive and stop control by the control means.

As described above, when settings of all the timers are completed (at a time point $t_1$ in FIG. 7), the reel control block 36 carries out steps ST7 to ST9 appearing in FIG. 4. First, at the step ST7, the first reel stop timer 47 is started, and at the following step ST8, drive pulses start to be supplied to the driver 41 to drive the stepping motor 44, whereby the first reel 3 starts rotation. Further, at the step ST9, the second reel correction timer 48 starts. In this connection, the stepping motor 44 causes the first reel 3 to enter the state of uniform rotation at the rotational speed $N_1$ at a time point $t_3$ which is the time period $T_1$ later than the time point ($t_1$) of start, as shown in FIG. 7.

Next, at a step ST10, when the second reel correction timer 48 runs out at a time point $t_2$ which is $T_3=100$ msec later than the time point $t_1$, the reel control block 36 start to send drive pulses to the stepping motor 45 by way of the driver 42, whereby at a step ST11 the second reel 4 starts rotation. At the same time, at a step ST12, the third reel correction timer 50 is started. In addition, the stepping motor 45 causes the second reel 4 to enter the state of uniform rotation at the rotational speed $N_1$ at a time point $t_4$ which is the time period $T_1$ later than the time point $t_2$ of start.

Next, at a step ST 13, when the third reel correction timer 50 runs out at a time point $t_4$ which is $T_4$=200 msec later than the time point $t_2$, the reel control block 36 start to send drive pulses to the stepping motor 46 by way of the driver 43, whereby at a step ST14 the third reel 5 starts rotation. In addition, the stepping motor 46 causes the third reel 5 to enter the state of uniform rotation at the rotational speed $N_1$ at a time point $t_6$ which is the time period $T_1$ later than the time point $t_5$ of start.

Thus, all the reels 3 to 5 each enter the state of uniform rotation at the fixed rotational speed at the step ST15.

Then, when the first reel 3 continues the uniform rotation from the time point $t_3$ to a time point $t_7$ which is the delay time period $T_5$ after the start of rotation thereof, the first reel stop timer 47 runs out, at a step ST16. At this time point $t_7$, the stop symbols of "BAR" on the reels 3, 4, and 5 are in the positional relationship indicated by ◎ in FIG. 6. Then, the reel control block 36 starts to check the position code indicative of the rotational position of the stop symbol of "BAR" on the first reel to determine whether or not the symbol of "BAR" has come to a rotational position suitable for causing the stop symbol of "BAR" to stop on the win line 10 at the end of stop control, i.e. deceleration of the first reel, at a step ST17 in FIG. 5. If it is determined that the stop symbol of "BAR" has come to the suitable position (at a time point $t_x$), the stop control of the first reel 3 is started.

That is, the reel control block 36 supplies pulses for stop control read from the drive pulse timing table 40 to the driver 40. This causes the stepping motor 44 to stop at a time point $t_8$, thereby stopping the first reel 3 at a step ST18. At this time point, the stop symbol of "BAR" on the first reel 3 is displayed on the win line 10. Further, at the time point $t_x$, the reel control block 36 starts the second reel stop timer 49 at a step ST19.

Then, at a step ST20, when the second reel stop timer 49 runs out (at a time point of $t_x+T_2=t_9$), the reel control block 36 supplies pulses for stop control to the driver 42. This causes the stepping motor 45 to stop at a time point $t_{10}$, thereby stopping the second reel 4 at a step ST21. At this time point, the stop symbol of "BAR" on the second reel 4 is displayed on the win line 10. Further, at the time point $t_9$, the reel control block 36 starts the third reel stop timer 51 at a step ST22.

Then, at a step ST23, when the third reel stop timer 51 runs out (at a time point of $t_9+T_2=t_{11}$), the reel control block 36 supplies pulses for stop control to the driver 43. This causes the stepping motor 45 to stop at a time point $t_{12}$, thereby stopping the third reel 5 at a step ST24. At this time point, the stop symbol of "BAR" on the third reel 5 is displayed on the win line 10.

In this way, when a row of symbols "BAR-BAR-BAR" is displayed along the win line 10, the control block 22 confirms the big hit with reference to the win symbol combination table **23*c* and the symbol table 23*b*. Thereafter, the control block 22 causes, by way of the driver 34, the coin payout device 35 to pay out a predetermined number of coins to the payout tray 16. In this connection, when the credit button 11 is pushed into an ON state, no coins are paid out to the payout tray 16, but are entered as credit. When the payout of coins or entry of same as credit is completed, the program returns to the step ST1 in FIG. 4**, where coins can be entered to start a subsequent play of the game.

In addition, when the win determination results in "a lose", a similar variable display procedure is carried out, whereby the three reel are stopped at time intervals of $T_2$=200 msec in the order of the first reel 3, the second reel 4, and the third reel 5.

Although in the above embodiment, as shown in FIG. 7, when the stop control of the reels is performed, the rotational speed of each reel is not instantly dropped to zero, but it take some time to bring each reel to a stop, this is not limitative, but a four-phase stepping motor of 1-2 phase excitation drive type may be used to thereby excite four phases at a time to hold the motor, thereby stopping the rotation of each reel instantly.

Further, although in the above embodiment, the reels are started in the order of the first reel 3, the second reel 4, and the third reel 5, this is not limitative, but the order of start of the reels 3, 4, and 5 may be varied depending on results of win determination.

Figure 8:
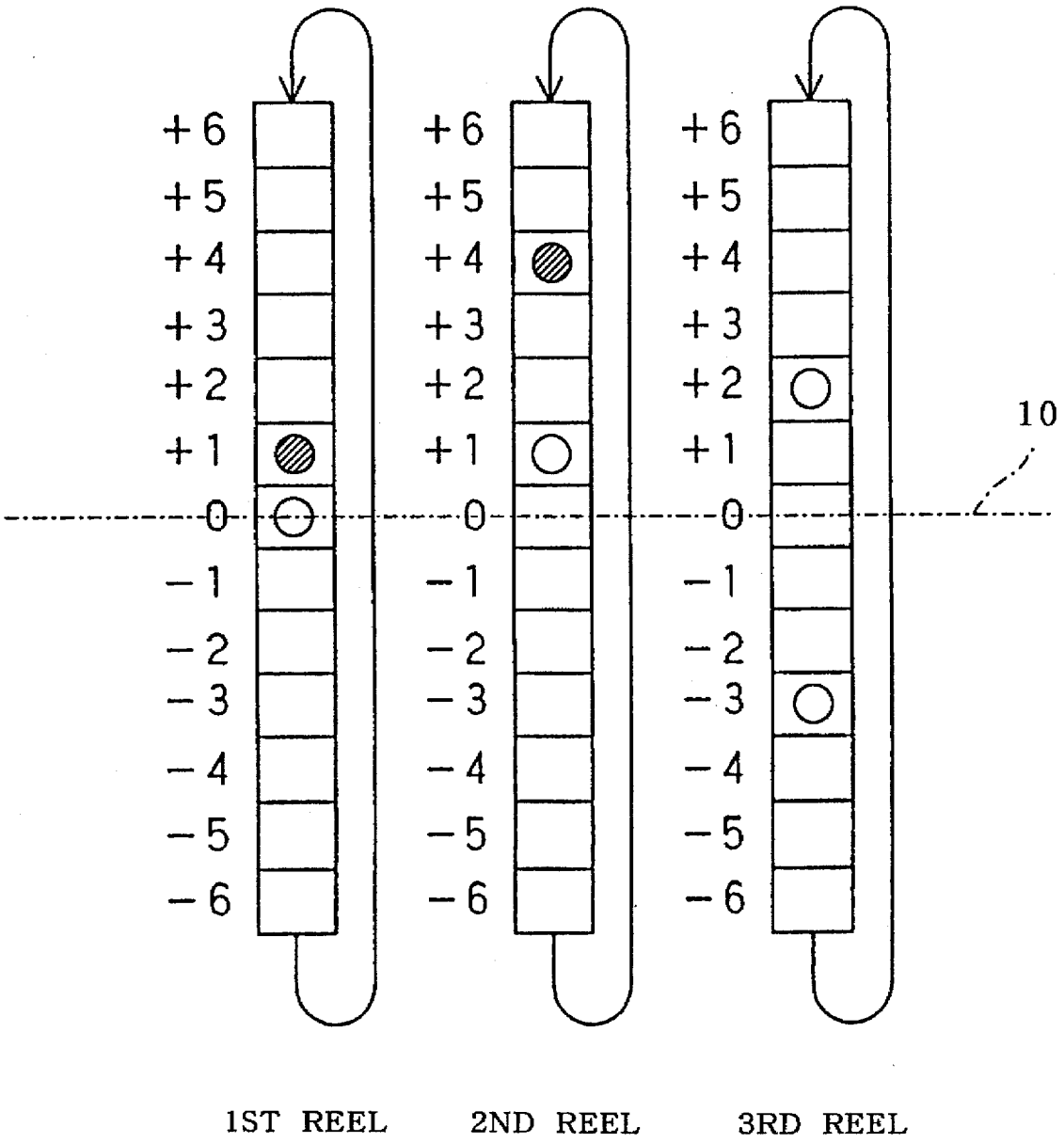
FIG. 8 is an explanatory diagram similar to FIG. 6 but distinguished therefrom in that positions of stop symbols on respective reels are different from those shown in FIG. 6.

For example, as shown in FIG. 8, when stop symbols to be stopped along the win line 10 in the present play of the game assume positions each indicated by the symbol of ●, if the reels should be started in the order of the first reel 3, the second reel 4, and the third reel 5, the delay time period $T_3$ is equal to 1200 msec and the delay time period $T_4$ is equal to 400 msec, as calculated from the equations (1) and (2). Therefore, after the start of the first reel 3, the delay time period $T_3$ should elapse before the start of the second reel 4, and further after the start of the second reel 4, the delay time period $T_4$ should elapse before the start of the third reel 5. This makes a time interval between the start of rotation of the first reel 3 and that of rotation of the second reel 4 too long compared with a time interval between the start of rotation of the second reel 4 and that of rotation of the third reel 5, which causes an odd impression to the player.

Figure 9:
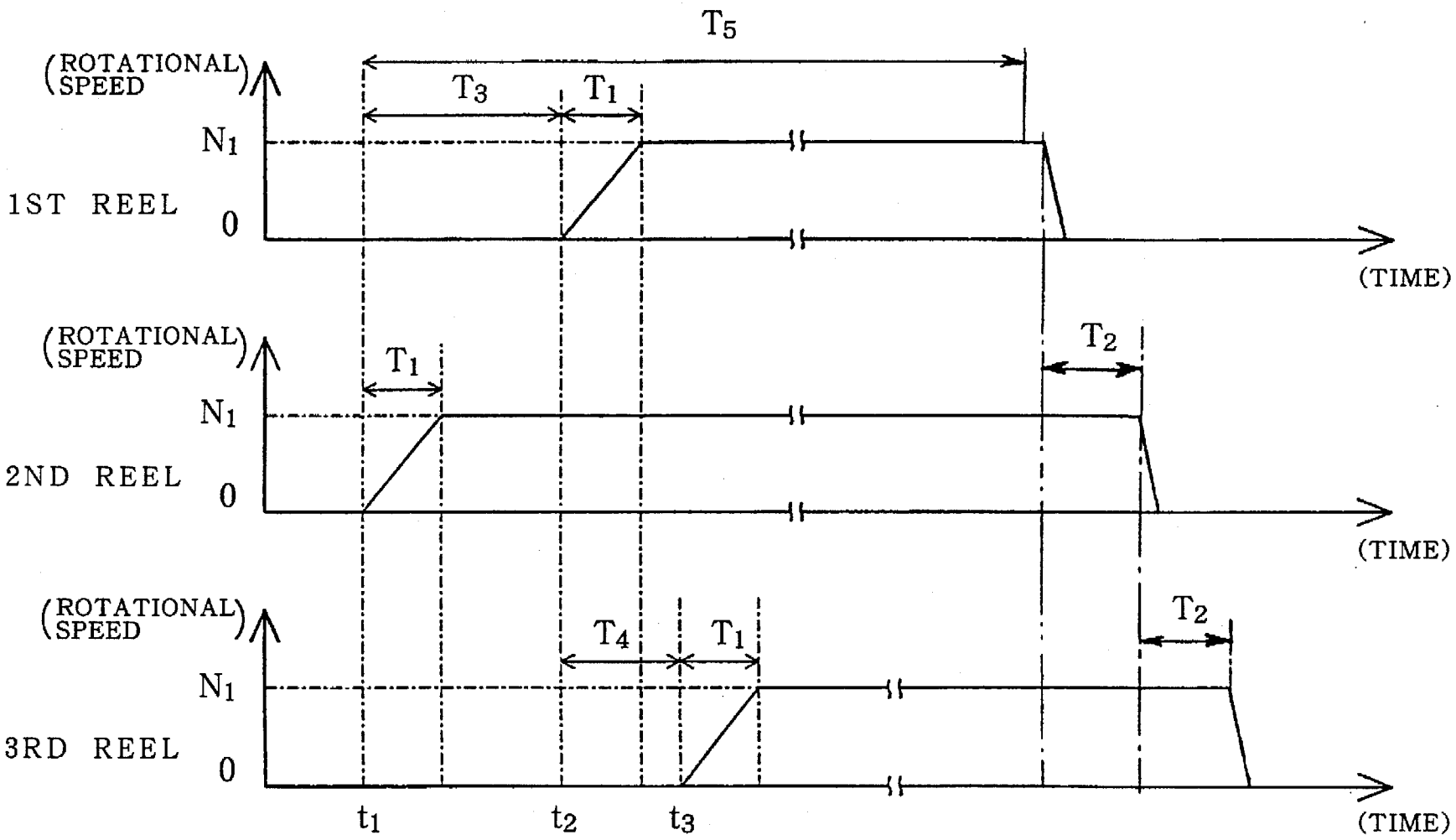
FIG. 9 is a timing chart similar to FIG. 7 but distinguished therefrom in that the three reels are driven for rotation in an order different from the order shown in FIG. 7.

To avoid this inconvenience, if the reels are started, as shown in FIG. 9, in the order of the second reel 4, the first reel 3, and the third reel 5, from the equations (1) and (2), the delay time period $T_3$ becomes equal to 500 msec, and the delay time period $T_4$ becomes equal to 300 msec. In this case, it is required that the second reel 4 is started at a time point $t_1$, and then the first reel 3 is started at a time point $t_2$, i.e. the delay time period of $T_3$=500 msec after the start of the second reel 4, followed by starting the third reel 5 at a time point $t_3$ the delay time period of $T_4$=300 msec after the start of the first reel 3. This reduces a difference in the time points of start of rotation of the reels compared with a case in which the reels are started in the order of the first reel 3, the second reel 4, and the third reel 5. Further, in this case, the time period $T_5$ set to the first reel stop timer 47 is substantially equal to a time period obtained by subtracting the time period $T_2$ from the whole time period during which the second reel 4 rotates.

Although, in the above case, the number of reels is three, this is not a limitation, but assuming that the number of reels is equal to a generalized value of n (≧2), the number of possible orders of start of the reels is equal to n!. Therefore, by selecting an order of the reels to be started which minimizes the differences between the time points of start of rotation of the reels, it is possible to sequentially place the reels into rotation without giving odd impressions to the player.

Figure 10:
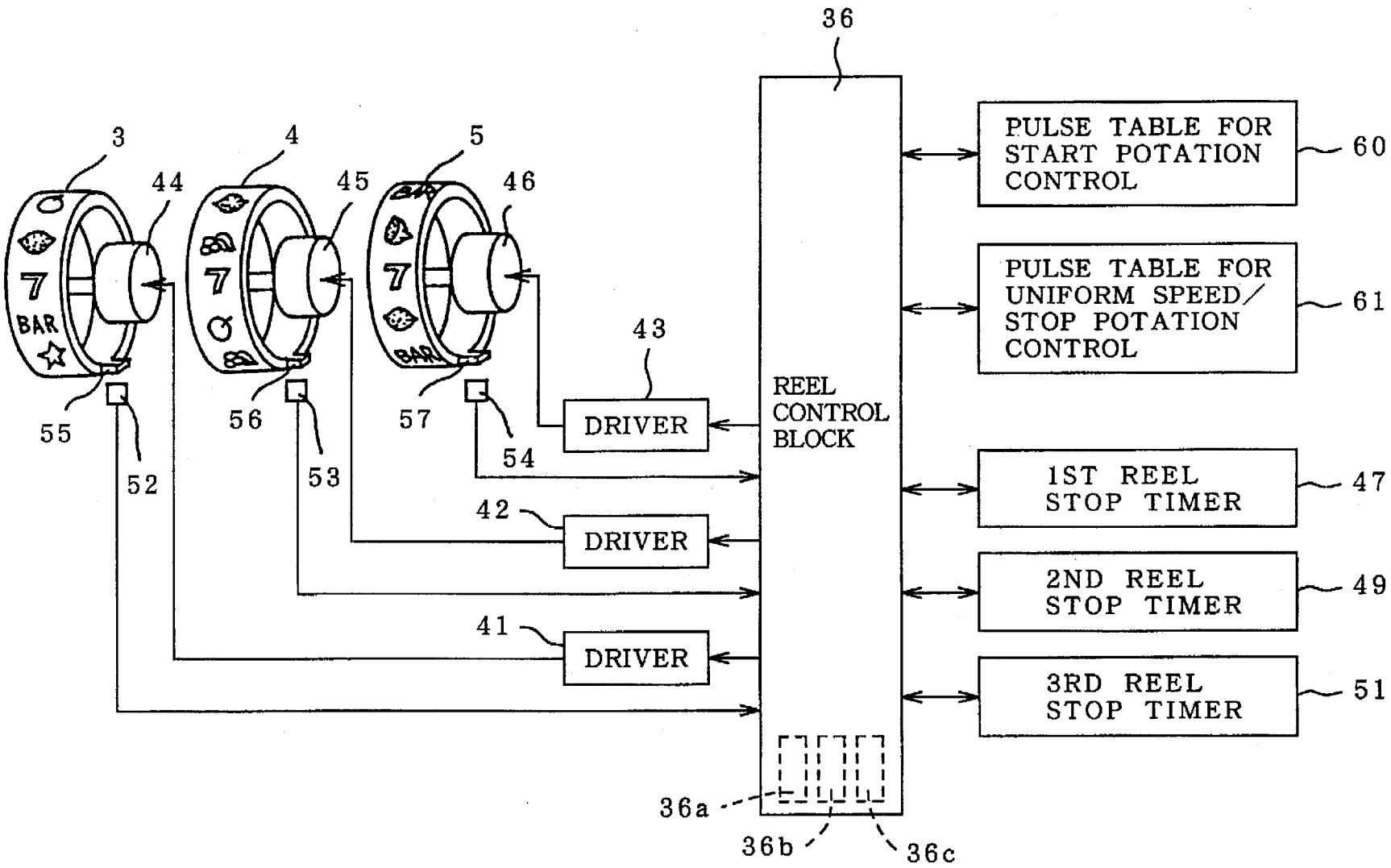
FIG. 10 is a diagram similar to FIG. 3 but distinguished therefrom in that the reel drive mechanism is controlled by a different control circuitry associated therewith.

FIG. 10 shows a reel control mechanism, i.e. a reel drive mechanism and a control circuitry associated therewith of a gaming machine (slot machine) according to another embodiment of the invention. In the slot machine using this reel control mechanism, three reels are started for rotation simultaneously, and time periods over which the three reels reach the predetermined rotational speed $N_1$ of the uniform rotation of the reels are varied. Then, the first reel 3, the second reel 4, and the third reel 5 are stopped at equal time intervals to cause desired symbols to be displayed along the win line 20. To this end, this embodiment is distinguished from the first embodiment in that the drive pulse timing table 40 appearing in FIG. 3 is replaced by a pulse table 60 for start rotation control and a pulse table 61 for uniform speed/stop rotation control, as shown in FIG. 10 and provided within the control block 22, with the first reel correction timer 48 and the third reel correction timer 50 appearing in FIG. 3 being omitted. The remainder of construction of the present embodiment is identical to that of the first embodiment, and hence identical component parts thereof will be designated by identical reference numerals, while omitting detailed description thereof.

According to this embodiment, the reels are started simultaneously, and acceleration of each reel up to the predetermined rotational speed of uniform rotation is varied, whereby the reels are caused to stop thereafter at equal time intervals.

Figure 11:
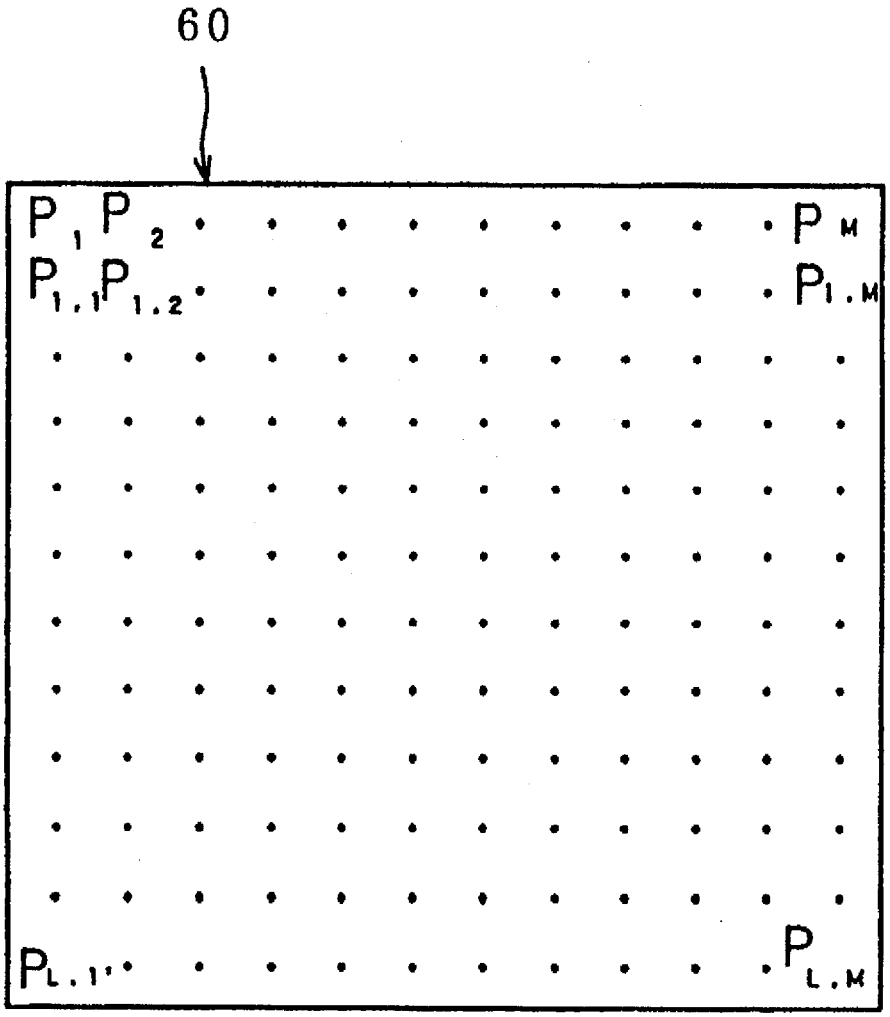
FIG. 11 is a diagram showing the concept of a pulse table for controlling the start of rotation for use in the FIG. 10 control circuit.

FIG. 11 shows contents of the pulse table for the start rotation control. The pulse table 60 for the start rotation control is comprised of reference data $P_1$ to $P_M$ of acceleration (M is a number which is determined according to a form of data) for generating pulses for driving the stepping motor of the first reel 3 to reach the uniform rotation, and L kinds of additional acceleration data $P_{L1}$ to $P_{LM}$ for correction of reel-to-reel discrepancy amounts according thereto. These sets of acceleration data are intended for changing time periods during which the reels are accelerated, for correction of the aforementioned reel-to-reel discrepancy amounts, and therefore, for a number A of all symbols on each reel, (A−1) additional sets of acceleration data items $P_{L1}$ to $P_{LM}$ are necessary, and hence L=A−1.

The pulse table 61 for the uniform speed/stop rotation is comprised of a single type of pulse data for uniform rotation and a single type of pulse data for stop control.

Figure 12:
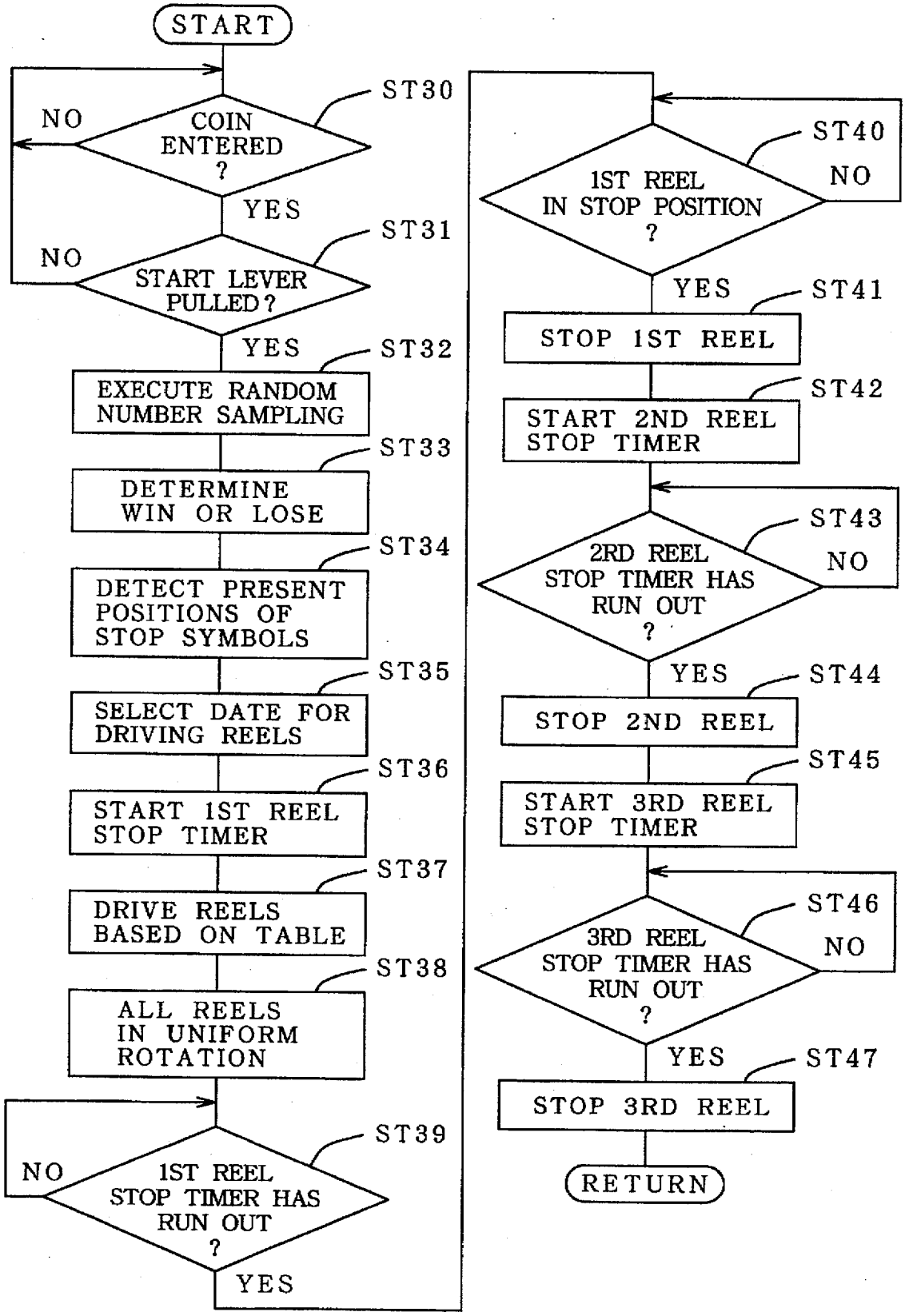
FIG. 12 is a flowchart showing reel control processing executed by the FIG. 10 control circuitry.

Referring to FIG. 12, if a coin is inserted at a step ST30, the start lever 15 is made operative. If the start lever 15 is operated or pulled at a step ST31, a start signal is delivered to the control block 22. In response to the start signal, the control block 22 causes the random number generator 32 and the sampling circuit 33 to operate at a step ST32, whereby a random number is sampled, and then a win determination on the sampled number as to whether the sampled number corresponds to any of the big hit, the medium hit, and the small hit is carried out at a step ST33 with reference to the win probability table 23*a*.

If the win determination results in the "big hit", the control block 22 determines a combination of symbols constituting the big hit (e.g. "BAR, BAR, BAR") with reference to the win symbol combination table 23*c* as described above in the first embodiment. Then, at a step ST34, the control block 22 detects the present positions of the symbols (stop symbols) "BAR" on the reels 3, 4, and 5, which are to be displayed along the win line when the reels are stopped with reference to the symbol table 23*b*.

Thus, similarly to the above embodiment, when particular ones of the symbol "BAR" on respective reels to be stopped on the win line at the end of the present play are determined, reel-to-reel discrepancy amounts are calculated by the correction amount-calculating block 26.

The correction amount-calculating block 26 determines the reel-to-reel discrepancy amount between the first reel 3 and the second reel 4 and that between the second reel 4 and the third reel 5, which are assumed to be "1" and "2", respectively, for example, in the present embodiment as well, and sends data of them to the time period-calculating block 27. The time period-calculating block 27 calculates, from the data of these reel-to-reel discrepancy amounts, i.e. correction amounts, delay time periods to elapse before the second reel 4 and the third reel 5 reach the predetermined rotational speed of uniform rotation, i.e. $T_3$ and $T_4$ in FIG. 13. Here, the accelerating time period $T_{21}$ for the first reel is determined from the reference data $P_1$ to $P_M$ of acceleration in the pulse table 60 for the start rotation control shown in FIG. 11. To the accelerating time period $T_{21}$, there is added the delay time period $T_3$, and the delay time period $T_4$ to the resulting sum, to thereby obtain the accelerating time periods $T_{22}$ and $T_{23}$, respectively. That is, $T_{22}=T_{21}+T_3$, and $T_{23}=T_{22}+T_4$. Further, a time period $T_{24}$ during which the first reel 24 continues to rotate is set to a predetermined suitable time period, similarly to $T_5$ appearing in FIG. 7.

Data of the accelerating time periods $T_{22}$ and $T_{23}$ thus obtained is sent to the reel control block 36 via the control block 22, based on which the reel control block 36 selects the reference data $P_1$ to $P_M$, and additional acceleration data $P_{x,1}$ to $P_{x,M}$, and $P_{y,1}$ to $P_{y,M}$ from the pulse table 60 for the start rotation control, at a step ST35. Symbols x and y represent respective numbers indicative of data selected this time (provided that, x, y≦L). In the meantime, the reel control block 36 sets the time period $T_{24}$ to the first reel stop timer 47.

Figure 13:
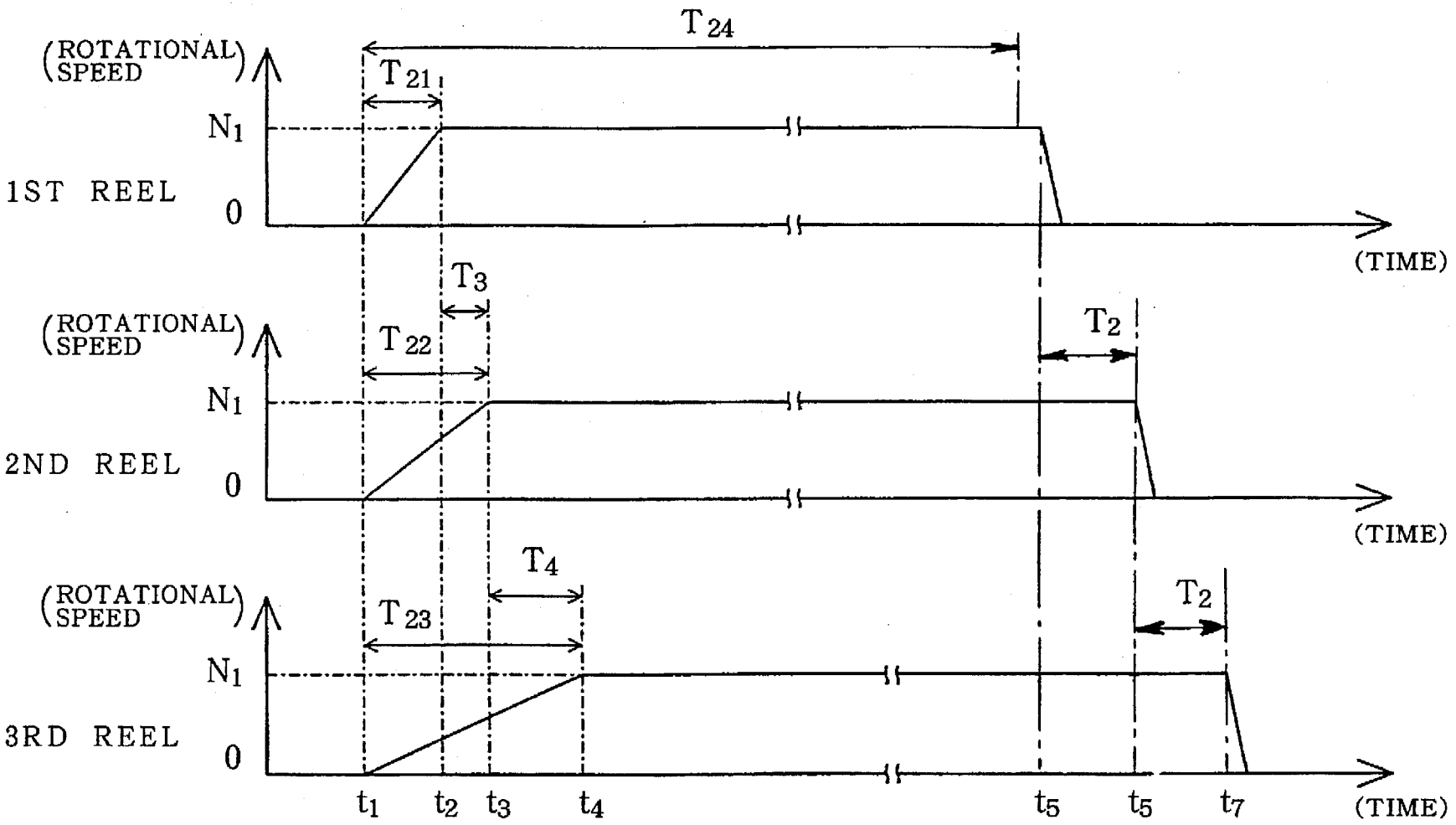
FIG. 13 is a timing chart showing operations of reels under drive and stop control in which a first reel starts to be driven at a reference acceleration.

Thereafter, the reel control block 36 starts the first reel stop timer 47 at a step ST36, and at the same time starts to drive the stepping motors 44, 45, and 46 by drive pulses generated based on the reference data $P_1$ to $P_M$ of acceleration, and the additional acceleration data $P_{x,1}$ to $P_{x,M}$, and $P_{y,1}$ to $P_{y,M}$. This causes all the reels 3, 4, and 5 to start rotation at a time point ($t_1$) of start of rotation of the reels, as shown in FIG. 13, at a step ST37 of the FIG. 12 program.

At a time point $t_2$ after the lapse of the accelerating time period Tfrom the time point $t_1$, the reel control block 36 sends drive pulses for uniform rotation based pulse data read from the pulse table 61 for the uniform speed/stop control to the driver 41, thereby setting the first reel 3 at the predetermined rotational speed of uniform rotation. Further, at a time point $t_3$ after the lapse of the accelerating time period $T_{22}$ from the time point $t_1$, the reel control block 36 sends drive pulses for uniform rotation to the driver 42, thereby setting the second reel 4 at the predetermined rotational speed of uniform rotation. Further, at a time point $t_4$ after the lapse of the accelerating time period $T_{23}$ from the time point $t_1$, the reel control block 36 sends the drive pulses for uniform rotation to the driver 43, thereby setting the third reel 5 at the predetermined rotational speed of uniform rotation. Thereafter, all the reels 3, 4, and 5 are driven for rotation at the predetermined rotational speed $N_1$ at a step ST38. This uniform rotation is continued until it is determined that the first reel stop timer 47 runs out (i.e. until the time period $T_{24}$ has elapsed after the time point $t_1$).

If it is determined at a step ST39 that the first reel stop timer 47 runs out, the reel control block 36 starts to check the position code indicative of the rotational position of the stop symbol of "BAR" on the first reel to determine whether or not the symbol of "BAR" has come to a rotational position suitable for causing the stop symbol of "BAR" to stop on the win line 10 at the end of stop control, i.e. deceleration of the first reel, at a step ST40. If it is determined that the stop symbol of "BAR" has come to the suitable position, the reel control block 36 sends drive pulses to the driver 41 based on pulse data read from the pulse table 61 for the uniform speed/stop control, whereby at a step ST41, the stop control of the stepping motor 44 starts at a time point $t_5$. Then, the rotation of the first reel 3 is stopped, and the symbol "BAR" on the first reel 3 is displayed on the win line 30. On the other hand, at the time point $t_5$, the control block 36 also starts the second reel stop timer 49, at a subsequent step ST42.

Thereafter, if it is determined at a step ST43 that the second reel stop timer 49 runs out, the reel control block 36 sends drive pulses for the stop control to the driver 42, whereby at a step ST44, the stop control of the stepping motor 45 starts at a time point $t_6$ ($=t_5+T_2$). This causes the rotation of the second reel 4 to be stopped, and the symbol "BAR" on the second reel 4 is displayed on the win line 10. On the other hand, at the time point $t_6$, the reel control block 36 also starts the second reel stop timer 51, at a subsequent step ST45.

Thereafter, if it is determined at a step ST46 that the third reel stop timer 51 runs out, the reel control block 36, the reel control block 36 sends drive pulses for the stop control to the driver 43, whereby at a step ST47, the stop control of the stepping motor 46 starts at a time point $t_7$ ($=t_6+T_2$). This causes the rotation of the third reel 5 to be stopped, and the symbol "BAR" on the third reel 5 is displayed on the win line 10.

Thus, a row of symbols "BAR-BAR-BAR" is displayed along the win line 10. Then, a predetermined number of coins are paid out, terminating a play of the game.

In this embodiment as well, as shown in FIG. 13, when the stop control of the reels is performed, the rotational speed of each reel is not instantly dropped to zero, but it take some time to bring each reel to a stop. However, this is not limitative, but a four-phase stepping motor of 1-2 phase excitation drive type may be used to thereby excite four phases at a time to hold the motor, thereby stopping the rotation of each reel instantly, as stated hereinabove.

Further, in the present embodiment, the second reel and the third reel are set to lower values of acceleration (i.e. the accelerating time periods are made longer) when they rise to the predetermined rotational speed, with reference to the acceleration (i.e. the accelerating time period) of the first reel. However, if the stop symbols to be stopped along the win line 10 are positioned at locations indicated by the symbol ● shown in FIG. 8, the difference $T_3$ in the accelerating time period between the first reel and the second reel and the difference $T_4$ in the accelerating time period between the second reel and the third reel are equal to 1200 msec, and 400 msec, which results in a large variation in the acceleration of the reels (i.e. accelerating time periods), giving odd impressions to the player.

Figure 14:
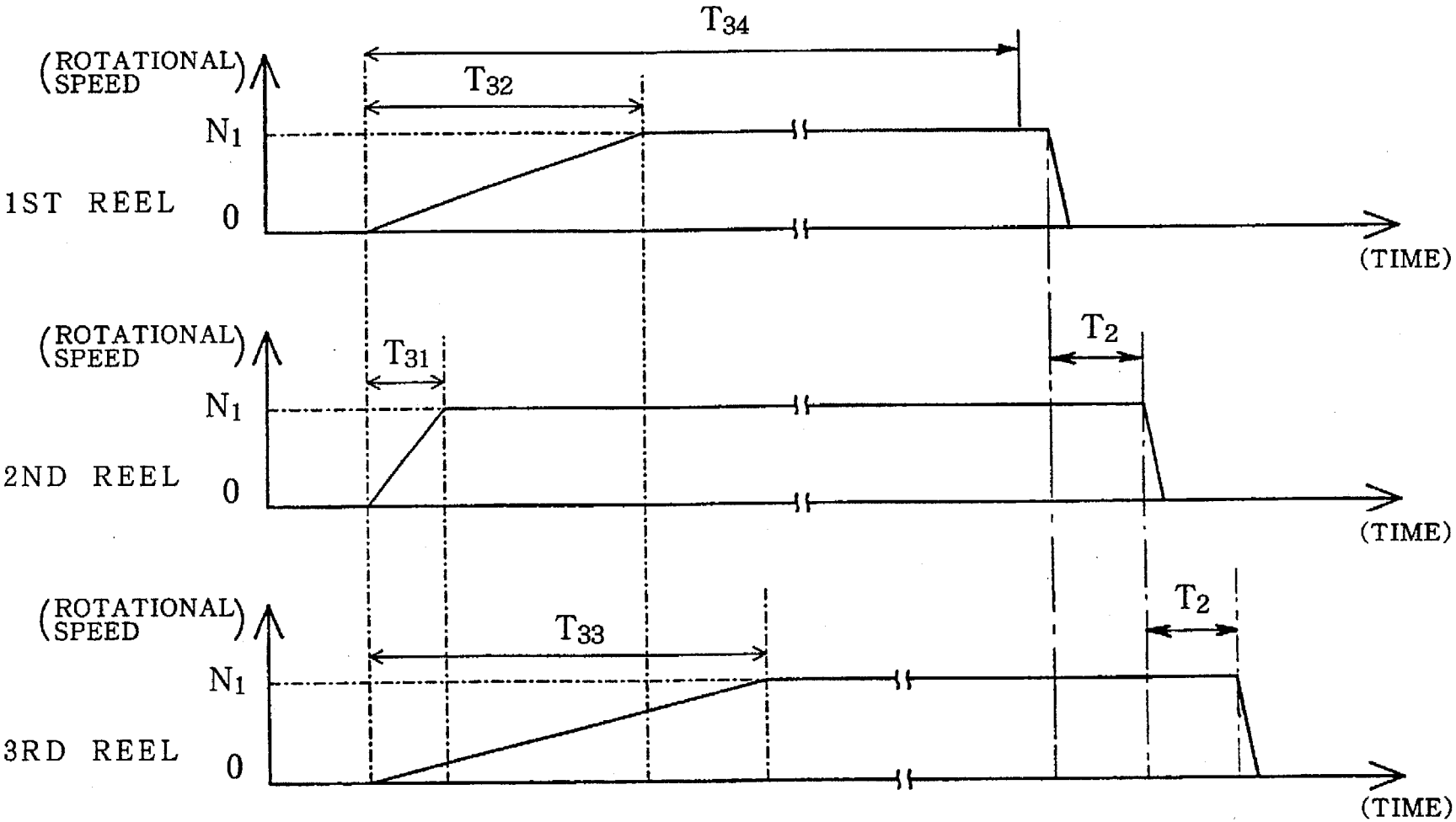
FIG. 14 is a timing chart showing operations of reels under drive and stop control in which a second reel starts to be driven at a reference acceleration.

To avoid this inconvenience, if a suitable value of acceleration of a reel other than the first reel, e.g. the acceleration of the second reel 4, as shown in FIG. 14 is used as a reference value, the accelerations of the first and second reels can be reduced, which makes it possible to prevent values of acceleration or accelerating time periods of the reels from exhibiting a large variation. More specifically, data of the start rotation control table 60 has only to be selected such that the second reel 4 be started at a highest acceleration (which enables same to reach the predetermined rotational speed of uniform rotation in a shortest accelerating time period $T_{31}$), with the first reel 3 being started at an acceleration which requires an accelerating time period $T_{32}$ which is 500 msec longer than the accelerating time period $T_{31}$, and the third reel 5 being started at an acceleration which requires an accelerating time period $T_{33}$ which is 300 msec longer than the accelerating time period $T_{32}$.

Thus, as described in the foregoing embodiment, if it is assumed that the number of reels is equal to a generalized value of n, the number of possible orders of start of the reels is equal to n!. Therefore, by selecting an order of the reels to be started which minimizes the differences between the accelerating time periods, it is possible to place the reels into rotation without giving odd impressions to the player.

Although in the above embodiments, description has been made of slot machines by way of example, this is not a limitation, but the present invention is suitably applied to ball-shooting game machines, such as pachinko game machines, which are provided with the variable display block. Further, a variation may be made to the invention, in which a total rotating time period of the first reel is first determined, and then based on start timing and stop timing of the first reel, the second reel and the third reel may be started and stopped. Further, another variation may be made to the invention, in which total rotating time periods of the first reel to the third reel are first determined, and start timing and stop timing of each of the reels are then determined based thereon, thereby controlling rotation of all the reels.

Although in the above embodiments, the number of reels is three, this is not a limitation, but the number may be two, or four or larger. Further, the reel stop control is performed in the order of the left reel to the right reel, this is not a limitation, but the order may be reversed, or may be stopped at equal time intervals in desired orders.

Further, although in the above embodiments, the win determination is made along one horizontal line as the win line 10, this is not a limitation but, the win line 10 may be provided as three horizontal lines and/or two diagonal lines, and then effect win determination along these lines. Further, means of movement or transfer of symbols is not limited to reels, but may be implemented by electric or electronic graphical display means, such as a liquid crystal display, an LED, or a CRT.

The foregoing is considered as illustrative only of the principles of the present invention. Further, since numerous modification and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed:

1. A gaming machine comprising:

a variable display device for variably displaying symbols for each of a plurality of symbol columns by moving said each of said plurality of symbol columns separately in a predetermined direction, said each of said plurality of symbol columns being formed by a plurality of symbols arranged in said predetermined direction;

drive signal-generating means for generating drive signal for operating said variable display device, when predetermined gaming conditions are satisfied;

stop symbol-determining means responsive to said drive signal for determining a combination of stop symbols to be displayed when said symbol columns are stopped;

position-detecting means for detecting positions of said stop symbols separately for said symbol columns, respectively, and for generating position signals indicative of said positions of said stop symbols, respectively;

correction amount-determining means for determining correction amounts for correcting said positions of said stop symbols based on said position signals generated by said position-detecting means; and control means responsive to said drive signal for controlling the movement and stop of said symbol columns displayed by said display means, such that the movement of said symbol columns is controlled at the start of movement thereof by the use of said correction amounts determined by said correction amount-determining means until the speed of movement of each of said symbols columns reaches a predetermined uniform speed.

2. A gaming machine according to claim 1, wherein said control means controls the movement and stop of said symbol columns, such that said stop symbols are lined up when said symbols columns are stopped, by using said correction amounts determined by said correction amount-determining means for correcting said positions of said stop symbols detected by said position-detecting means to thereby cause said symbols to be lined up when said symbols columns are stopped.

3. A gaming machine according to claim 1, wherein said correction amounts are defined as differences in time points of start of the movement of said symbol columns.

4. A gaming machine according to claim 2, wherein said correction amounts are defined as differences in time points of start of the movement of said symbol columns.

5. A gaming machine according to claim 3, wherein said control means starts the movement of said plurality of symbol columns in such an order that said differences in time points for starting the movement of said symbol columns become the minimum.

6. A gaming machine according to claim 4, wherein said control means starts the movement of said plurality of symbol columns in such an order that said differences in time points for starting the movement of said symbol columns become the minimum.

7. A gaming machine according to claim 1, wherein said correction amounts are defined as differences in accelerating time periods over which said symbol columns are accelerated until the speed of movement of each of said symbol columns reaches said predetermined uniform speed.

8. A gaming machine according to claim 2, wherein said correction amounts are defined as differences in accelerating time periods over which said symbol columns are accelerated until the speed of movement of each of said symbol columns reaches said predetermined uniform speed.

9. A gaming machine according to claim 7, wherein said control means starts the movement of said plurality of symbol columns with reference to an accelerating time period of a first one of said plurality of symbols columns to be started for movement, in such an order that said differences in said accelerating time periods become the minimum.

10. A gaming machine according to claim 8, wherein said control means starts the movement of said plurality of symbol columns with reference to an accelerating time period of a first one of said plurality of symbols columns to be started for movement, in such an order that said differences in said accelerating time periods become the minimum.

11. A gaming machine according to claim 1, wherein said gaming machine is a slot machine.

* * * * *